US006561834B2

(12) United States Patent
Chen

(10) Patent No.: US 6,561,834 B2
(45) Date of Patent: May 13, 2003

(54) CONNECTOR ASSEMBLY HAVING A LATCHING MECHANISM

(75) Inventor: Ping Chen, West Bloomfield, MI (US)

(73) Assignee: J.S.T.Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/077,993

(22) Filed: Feb. 20, 2002

(65) Prior Publication Data

US 2002/0119693 A1 Aug. 29, 2002

(30) Foreign Application Priority Data

Feb. 26, 2001 (JP) ..... 2001-050069

(51) Int. Cl.[7] ..... H01R 13/627
(52) U.S. Cl. ..... 439/358; 439/357
(58) Field of Search ..... 439/352, 358, 439/357, 595

(56) References Cited

U.S. PATENT DOCUMENTS 4,708,413 A * 11/1987 Schroeder ..... 438/358
5,378,168 A * 1/1995 Sumida ..... 439/358
5,762,514 A * 6/1998 Iong et al. ..... 439/358
5,830,002 A * 11/1998 Ito et al. ..... 439/358
6,364,685 B1 * 4/2002 Manning ..... 439/357
6,325,656 B1 * 12/2002 Fukuda et al. ..... 439/358

* cited by examiner

*Primary Examiner*—Tho D. Ta
*Assistant Examiner*—Larisa Tsukerman
(74) *Attorney, Agent, or Firm*—Antonelli, Terry, Stout & Kraus, LLP

(57) ABSTRACT

A connector assembly has a male connector (1) engaging with a female connector (2), and a latching mechanism is composed of a lockable lug (23) formed on a female housing (4) and a lock arm (10) formed on a male housing (3). Elastically deforming hinge-shaped feet (13) have each one end integral with the male housing and the other end continuing from the lock arm, whose pawl (11) corresponds to the lug (23), so that the lock arm (10) rocks about the feet to engage the pawl with the lug. A push lever (12) has lateral ends integral with the lock arm's rear end disposed in rear of the feet (13). A supplementary resilient arm (14) continues from the rear end to be inclined down and forwards. Its fore end is fixed on the outer surface of male housing (3), such that the housings are firmly locked together to give a stronger 'click' feeling for detection of engagement, with wire ends from any foreign harness never catching the push lever.

5 Claims, 7 Drawing Sheets

CONNECTOR ASSEMBLY HAVING A LATCHING MECHANISM

BACKGROUND OF THE INVENTION

1. Field of the Invention

The present invention relates to a connector assembly composed of a pair of male and female connectors mating one another and having a latching mechanism, wherein the male connector fits in the female connector to establish an electric communication between them.

2. Prior Art

Many connector assemblies each comprising a latching mechanism of this type have been known in the art. In each assembly having the latching or interlocking mechanism which the present invention addresses, one connector housing (viz., a first housing) has a lockable lug formed on the outer surface thereof. The other connector housing (viz., a second housing) has a lock arm formed integral with a pawl capable of engaging with the lockable lug. Elastically deformable hinge-shaped feet formed on the second housing serve to releasably secure the lock arm to the outer surface of second housing. The second housing has also a push lever formed on the rear end of the lock arm, to be disposed rearwardly of the hinge-shaped feet.

The prior art latching or interlocking mechanism formed in the connector assembly of this type is however disadvantageous in that the hinge-shaped feet securing the lock arm to the second housing are not of a sufficient mechanical strength. Engagement of such a lock arm with such a lockable lug on the first housing can hardly ensure durable and strong connection of the housings one with another. The prior art structure has thus often failed to ensure reliable electrical connections, when used in certain vibrating machines such as automobiles. It is a further problem relevant to this drawback that 'snap-fit' feeling has scarcely been produced when engaging the lockable lug with the lock arm, unfortunately making it difficult to confirm their mutual connection from outside. In addition, many wire ends will be pulled over and/or twisted around the connectors when attached thereto, thereby imparting a wrenching action to the first and second housings. In such an event, engagement of the lock arm with the lockable lug is likely to be released. If however mutual retention and mechanical strength of those lug and arm in the connectors would be designed excessively high, then they could not easily engage with or disengage from each other.

A gap is present between the push lever and the outer surface of second housing, with the push lever being formed as a rear end portion of the lock arm as mentioned above. Due to such a gap, electric wire ends involved in adjacent harnesses have often pressed undesirably the push lever to unlock the lockable lug out of the lock arm. This drawback has been most prominent in case of arranging a number of electric wire ends within such a narrow space as those in automobiles. In addition, electric wire ends of the neighboring harnesses have sometimes got in the gap to be jammed therein, accidentally catching the push lever and hindering the wiring operations.

SUMMARY OF THE INVENTION

The present invention was made in view of the drawbacks inherent in the prior art structure. An object of the invention is therefore to provide an improved connector assembly having a latching mechanism constructed such that male and female connector housings are interlocked more surely and more firmly with each other by a lock arm and a lockable lug engaging therewith. The improvement has also to be such that 'snap-fitting' of said connectors is felt more easily by a user or operator when they mate one another, and foreign wires belonging to any neighboring harness are protected from being caught by the push lever.

In order to achieve the object, the present invention provides a connector assembly composed of a pair of male and female connectors, having a latching mechanism and comprising a lockable lug formed on an outer surface of a first housing that constitutes one of the connectors, a lock arm formed on an outer surface of a second housing that constitutes the other connector, and a pair of elastically deforming hinge-shaped feet each having one end integral with the second housing. Each hinge-shaped foot has another end continuing from the lock arm, the lock arm is formed integral with a pawl corresponding to the lockable lug, and the lock arm is capable of rocking about the hinge-shaped feet so as to cause its pawl to engage with the lockable lug. The assembly further comprises a push lever having lateral ends formed integral with a rear end of the lock arm and disposed in rear of the hinge-shaped feet, and characteristically the second housing further comprises supplementary resilient arms continuing from the rear end of the lock arm. Each supplementary resilient arm is inclined down to extend forwards, with its fore end being fixed on an adjoining portion of the outer surface of the second housing.

Preferably, the fore end of the supplementary resilient arm may extend to the proximity of the hinge-shaped feet.

Also preferably, the second housing may have along its upper face a guard that is composed of a pair of side plates and a top plate continuing from the upper ends of the side plates. The lock arm intervenes between these side plates so that its fore half may be covered with the top plate of said guard. The lock arm's hinge-shaped feet may be formed integral with the corresponding inner face portions of the guard's side plates, respectively.

The male connector's second housing (viz., male housing) has a cavity opening forwards so that pin contacts each fixed on wire ends are exposed in the cavity. The female connector's first housing (viz., female housing) fitting in the cavity has compartments holding therein socket contacts insulated from each other and corresponding to the pin contacts.

In operation of coupling the male and female connectors, a considerably strong stress will be imparted to and accumulated in the supplementary resilient arm continuing from the lock arm's rear end, due to an elastic temporary deformation of this resilient arm. Elastic recovery will consequently be facilitated for the lock arm, thereby amplifying the feeling of snap-fit. Width and thickness of the supplementary resilient arm may be adjusted to give an optimal bending strength (elasticity) such that the lock arm has an increased rigidity enhancing relative interlock of the male and female housings, without making the connectors difficult to engage with and disengage from each other. Further, the guard for the lock arm will prevent wire ends of any foreign harness from catching the push lever or from unintentionally moving same to release the lock arm from the lockable lug.

THE PREFERRED EMBODIMENTS

Figure 1:
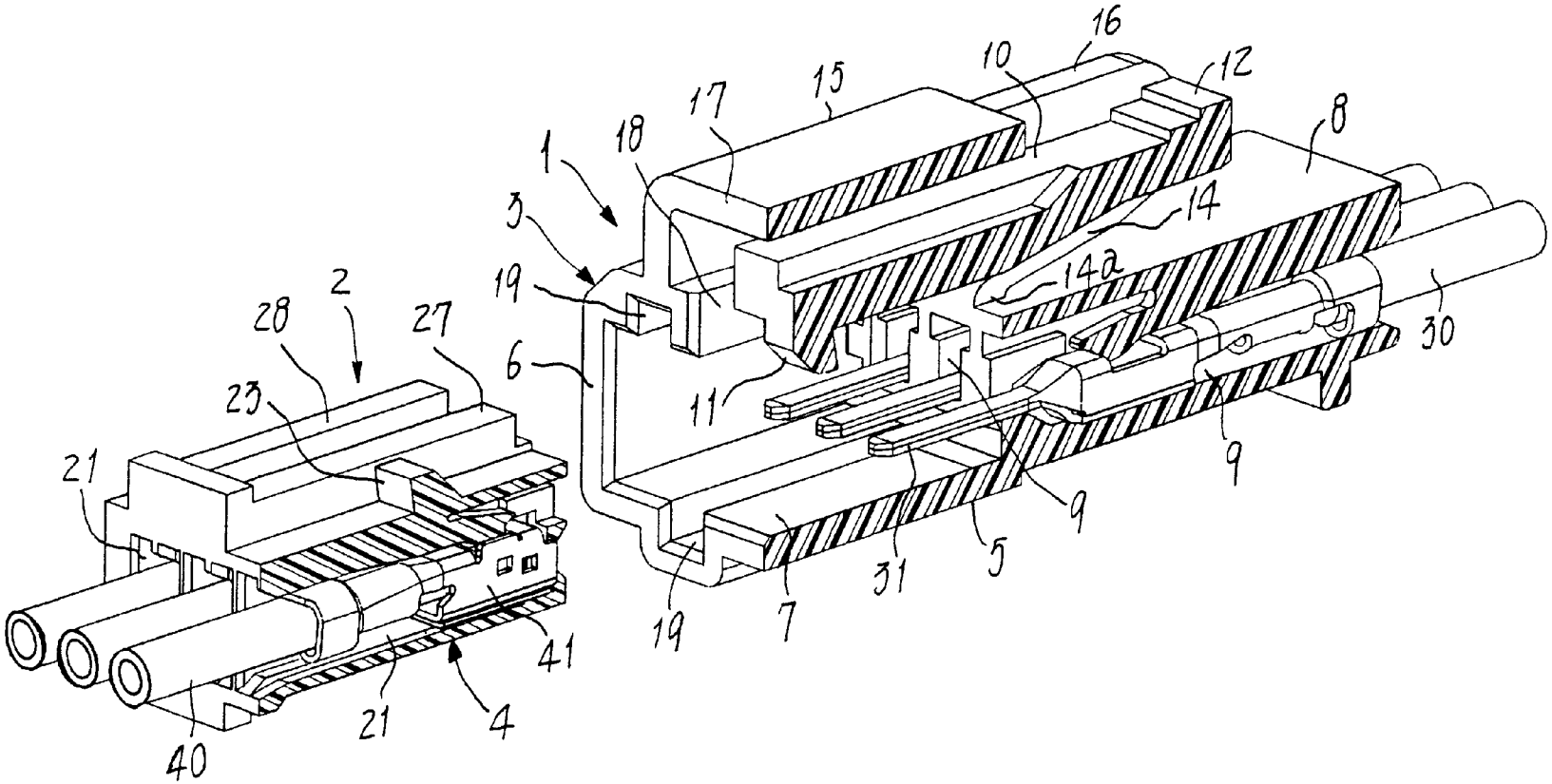
FIG. 1 is a perspective view of an assembly of connectors provided in an embodiment of the present invention, with the assembly having a latching mechanism and shown partly in cross section.
Figure 2:
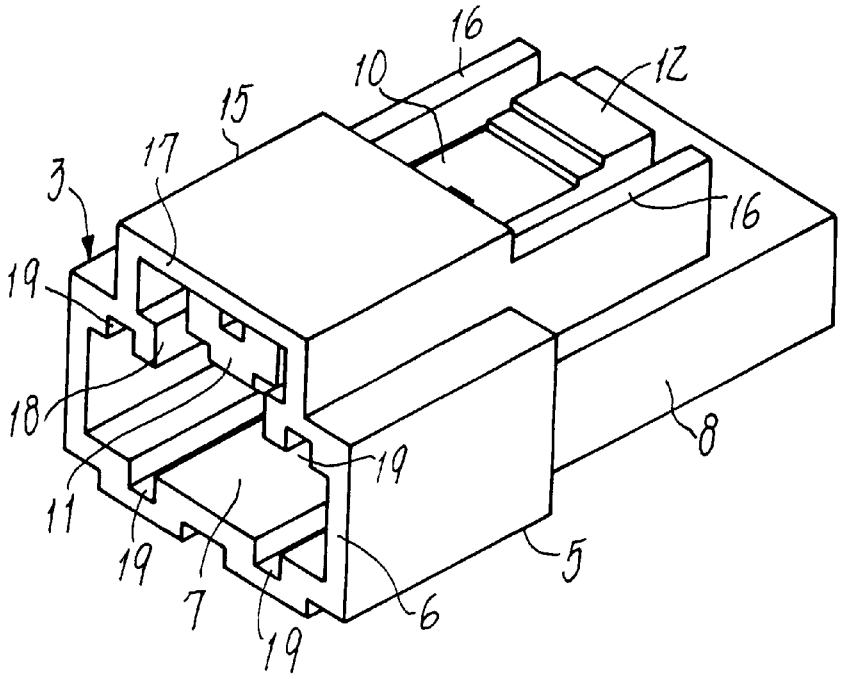
FIG. 2 is a perspective view of a male housing included in the connector assembly.
Figure 3:
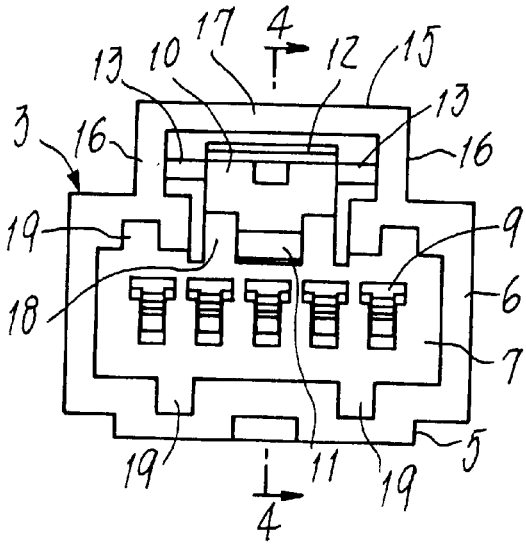
FIG. 3 is a front elevation of the male housing.
Figure 4:
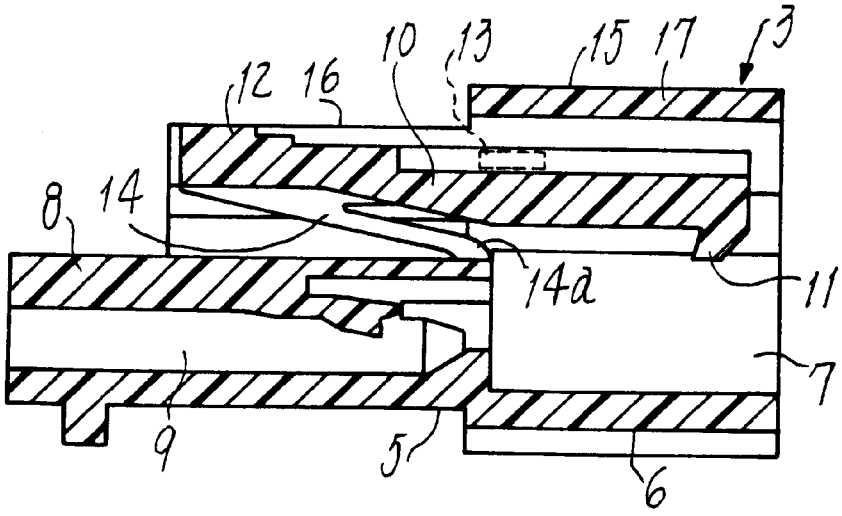
FIG. 4 is a cross section taken along the line 4—4 in FIG. 3.
Figure 5:
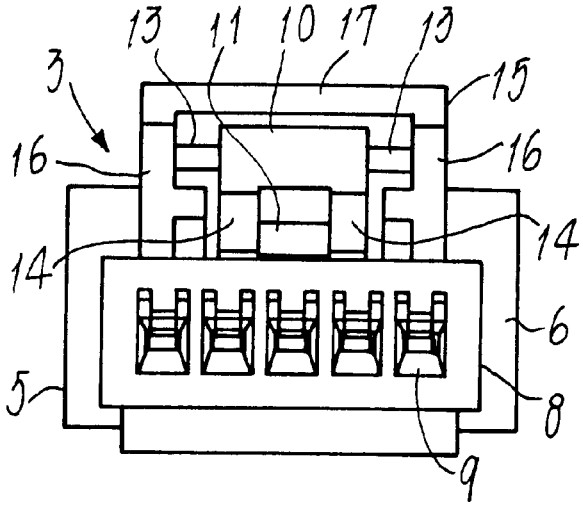
FIG. 5 is a rear elevation of the male housing.

Now some embodiments of the present invention will be described referring to the drawings.

FIG. 1 shows a connector assembly having a latching mechanism provided herein. A plurality of wire ends 30 are electrically connected to another plurality of wire ends 40 by the present connector assembly that is exemplified herein as of the relay or junction type. This assembly is composed of a male connector 1 and a female connector 2 fitting therein. The male connector 1 comprises a housing (hereinafter referred to as 'male housing') 3, and the female connector 2 comprises another housing (hereinafter referred to as 'female housing') 4, both the housings being made of an insulating resin such as Nylon (a registered trademark).

As shown in FIGS. 2 to 5, a main body 5 of the male housing 3 consists of a generally square cylinder 6 having a cavity 7 opened forwards and a flat and elongate parallelepiped box 8 formed integral with the square cylinder 6. A plurality of pin contacts 31 (see FIG. 1) crimped on the wire ends 30 are held in discrete compartments 9 formed in the parallelepiped box 8. Those pin contacts 31 whose pointed ends protrude into the cavity 7 are thus separated from each other within the male housing. A lock arm 10 and a guard 15 for protection thereof are formed together integral with an upper region of the male housing's main body 5.

The lock arm 10 has at its fore end portion a pawl 11 formed integral therewith for engagement with a lockable lug 23 (detailed below) of the female housing 4, wherein said fore end portion is disposed near the fore mouth of the square cylinder 6. A push lever 12 is formed integral with the rear end of lock arm 10, and the intermediate portion thereof is supported by a pair of transversely extending hinge-shaped feet 13. These feet (see FIGS. 3 and 4) have their ends secured to side walls 16 of the guard 15 (detailed below). A pair of supplementary resilient arms 14 continuing from opposite lateral and lower edges of the rear end of said push lever 13 are inclined down to extend forwards. Each resilient arm 14 has its fore end 14*a* located in proximity of the corresponding hinge-shaped foot 13 and bonded to or otherwise fixed on a fore upper edge portion of the parallelepiped box 8 of housing main body 5.

The guard 15 consists of three integral portions, that is a pair of the side walls 16 and a top 17. These side walls 16 are erected upright on the upper face of main body 5, along the side faces of the lock arm 10, with the top 17 bridging the gap between upper ends of the side walls so as to cover the lock arm's 10 fore half where the pawl 11 is located. The hinge-shaped feet 13 has lateral ends secured to the inner surfaces of side walls 16, so that twisting motion of each foot 13 serving as a fulcrum permits the lock arm 10 to make a rocking or seesaw motion about these feet. The side walls 16 of this guard 15 confront the side faces of lock arm 10 so as to inhibit foreign wire ends from entering the gap between the push lever 12 and the housing's main body 5.

A cutout 18 is formed in the middle region of upper wall of the square cylinder 6, lest the rocking lock arm 10 should interfere with the main body 5. Guide grooves 19 extending longitudinally of the square cylinder's 6 upper wall and bottom and located in the facing portions thereof will facilitate smooth and neat insertion of the female housing 4.

Figure 6:
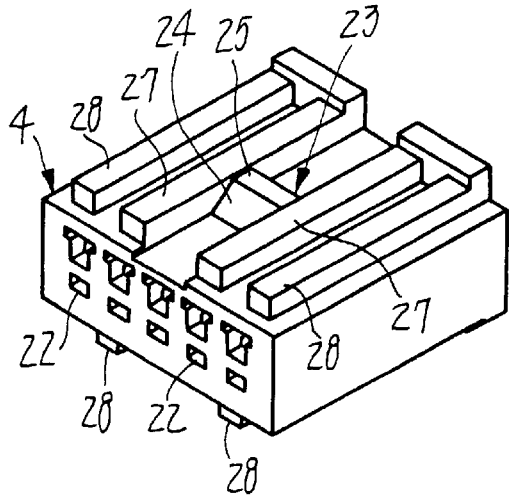
FIG. 6 is a perspective view of a female housing also included in the assembly.
Figure 7:
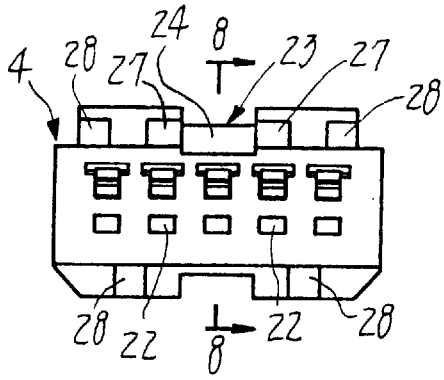
FIG. 7 is a front elevation of the female housing.
Figure 8:
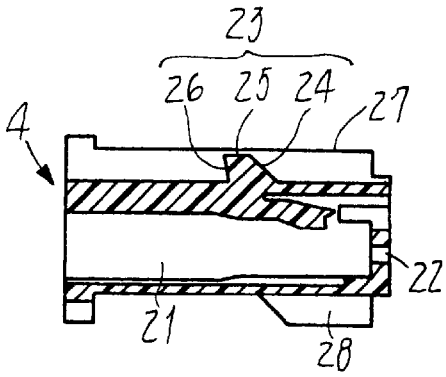
FIG. 8 is a cross section taken along the line 8—8 in FIG. 7.

As shown in FIGS. 6 to 8, the female housing 4 is of a parallelepiped shape fitting in the cavity 7 of male housing's square cylinder 6. Socket contacts 41 (see FIG. 1) crimped on the wire ends 40 are held in compartments 21 insulated from each other and corresponding to the pin contacts 31 in the male connector 1. Apertures 22 formed in the front wall of those compartments 21 serve to receive the pointed ends of pin contacts 31. A lockable lug 23 protrudes up from the central portion of an upper wall of the female housing 4. This lug 23 has a slope 24 inclined down and forwards, a horizontal summit 25 extending backwards from the rear end of said slope, and a vertical shoulder 26 descending from the rear end of said summit. The upper outer face of female housing 4 has upper and inner longitudinal ridges 27 formed beside the lockable lug 23 so as to engage the cutout 18 in the male housing 3, in addition to upper and outer ridges 28 for engagement with the upper guide grooves 19 in male housing. Lower ridges 28 similarly formed integral with the outer face of male housing's bottom will engage with the lower guide grooves 19 in male housing.

Figure 9:
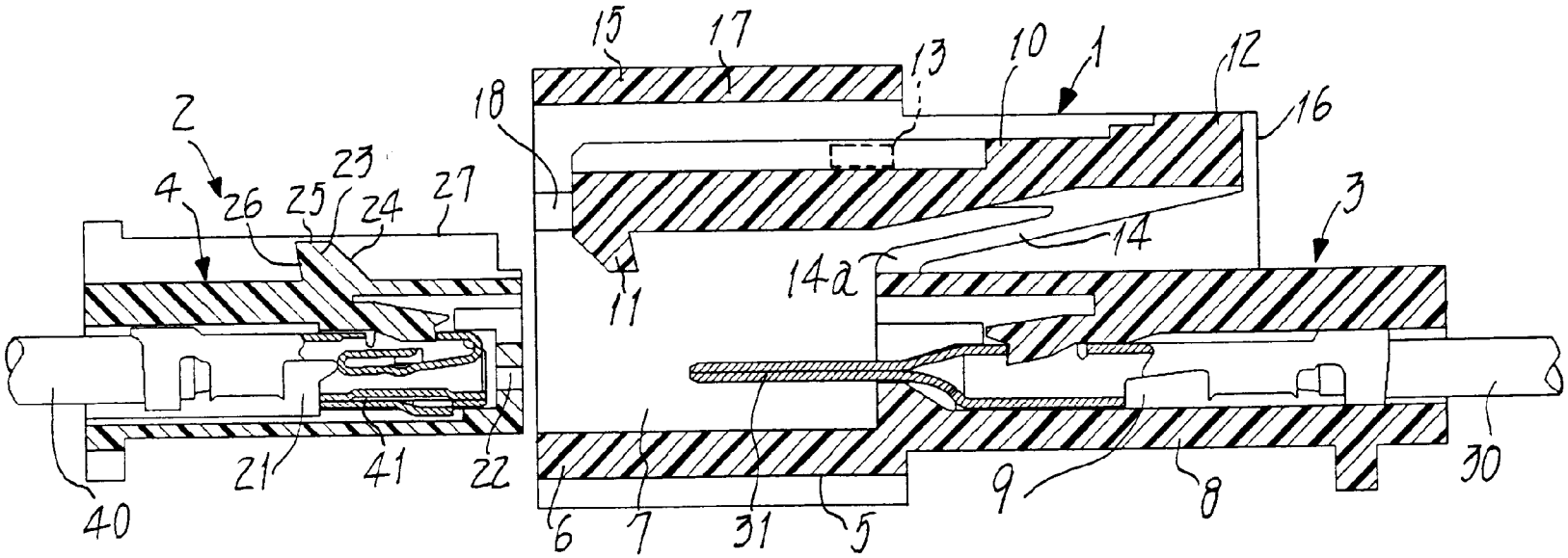
FIG. 9 is a vertical cross section of the connectors just prior to mutual engagement.
Figure 10:
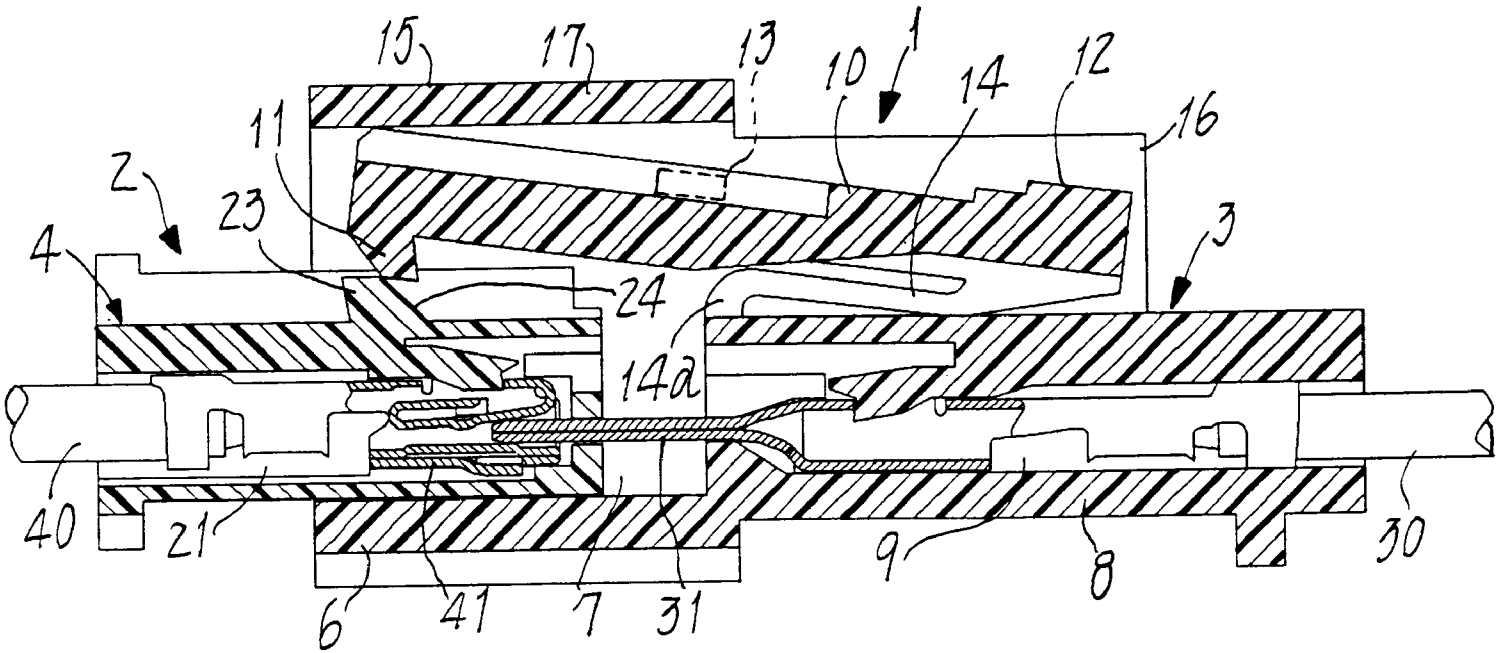
FIG. 10 is a vertical cross section of the connectors shown in their interim state just coming into engagement with each other.
Figure 11:
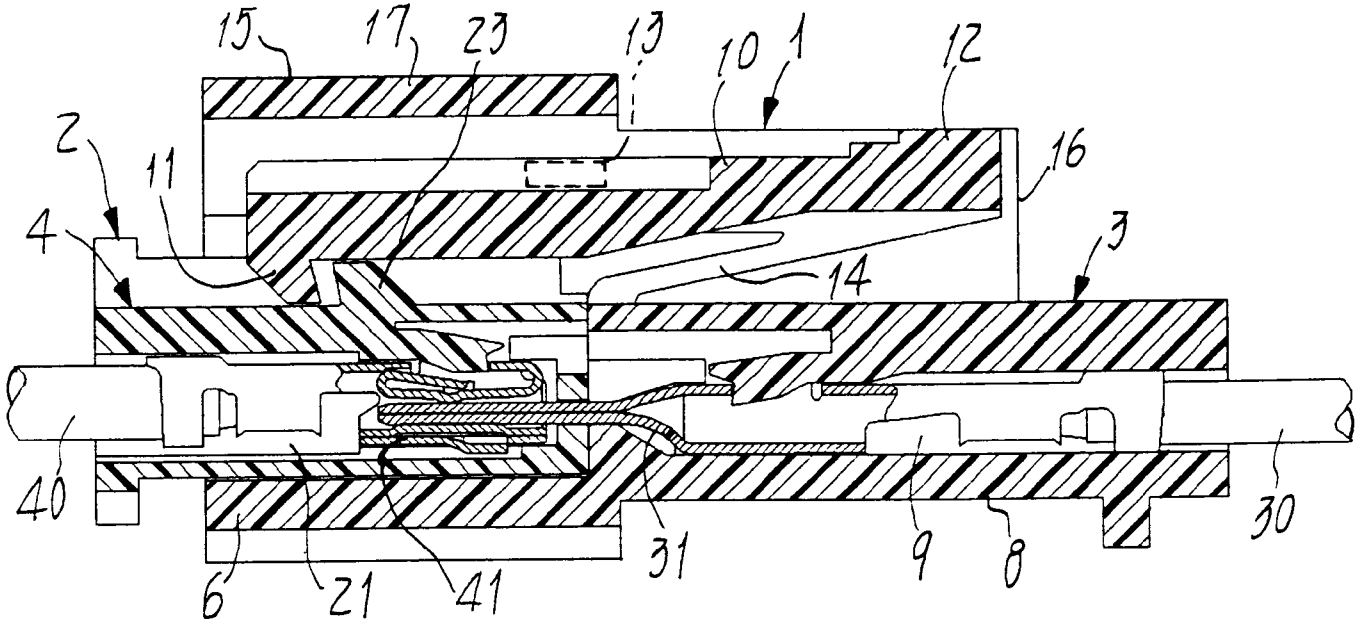
FIG. 11 is a vertical cross section of the connectors having completely engaged with each other.

FIGS. 9 to 11 illustrate the male and female connectors 1 and 2 that are ready to be fitted one in another (FIG. 9), half-fitted (FIG. 10) or completely fitted (FIG. 11).

As mentioned above, the housing 4 of the female connector 2 has the socket contacts 41 fixed therein and crimped on the one wire ends 41, and the housing 3 of male connector 1 has the pin contacts 31 fixed therein and crimped on the other wire ends 31. At first, the female housing 4 will be put in the fore mouth of male housing 3 towards the cavity 7 thereof (as seen in FIGS. 9 and 10). The inner ridges 27 consequently fit in the cutout 18, with the outer and lower ridges 28 simultaneously fitting in the grooves 19 so as to guide the female housing deep into the male housing. Subsequently, the pawl 11 on the lock arm 10 will collide with the female housing's lockable lug 23, and move along the slope 24 thereof (as seen in FIG. 10). As a result, the fore half of lock arm 10 is pushed up, rocking about the hinge-shaped feet 13 that serve as a fulcrum, and simultaneously displacing downwards the push lever 12. In unison with such a lowering of the push lever, the supplementary resilient arms 14 will be forced against its elasticity to take its compressed position, thereby storing an intensive elastic energy in the resilient arms. A wrenching force that is applied to each hinge-shaped foot 13 will also cause accumulation of elastic energy therein. On the other hand, the pin contacts 31 of male connector 1 enter the female housing's 4 compartments 21 through the apertures 22, until fitting in the corresponding socket contacts 41. As the female housing 4 advances deeper in the cavity 7, the pawl 11 of lock arm will ride over the summit 25 of lockable lug 23 as shown in FIG. 11. Consequently, elastic recovery of the lock arm 10 brings the pawl into engagement with the shoulder 26 of lockable lug. Thus, the female housing 4 latched in the male housing 3 establishes electric communication between the pin contacts 31 with the corresponding socket contacts 41. At this instant, these housings fitting one in another produce a clicking shock and sound ('snapping' reaction) for an easy and sure confirmation of perfect and releasable mutual connection of the mating members. It will now be apparent that elastic energy stored in the temporarily stored in the resilient arms 14 is added to that which has been produced in the wrenched feet 13. Such a process will be effective not only in amplifying the 'snapping' feeling but also in enhancing retention of the housings due to engagement of the lock arm 10 with the lockable lug 23. The male and female connectors 1 and 2 coupled in this way will work thereafter to relay electric currents through the wire ends 30 to the other wire ends 40.

In order to release the female connector 2 from the male connector 1 as shown in FIG. 11, the push lever 12 need be pushed down to elastically deform the resilient arms 14 and raise the fore half of lock arm 10 pivoting about the hinge-shaped feet 13. This action will release the pawl 11 from the lockable lug 23, to thereby unlatch the female housing 4 out of male housing 3 in order for removal of the former from the latter.

In summary, the lock arm in the present invention is connected to the male housing by the elastic hinge-shaped feet and also by the resilient arms continuing from the rear end of lock arm. By virtue of this feature, rigidity of the lock arm is increased to improve retention of the relevant members. A greater amount of energy stocked in the resilient arm when coupling the connectors one with another will enhance elastic recovery of the lock arm, besides an intensified 'snapping' feeling facilitating completion of the fitting connection of connectors.

The guard integral with the housing protests the lock arm from being caught by wire ends of any foreign harness, whereby the push lever will no longer be moved unintentionally to release the latching member.

What is claimed is:

1. A connector assembly composed of a pair of male and female connectors, having a latching mechanism and comprising:

a lockable lug formed on an outer surface of a first housing that constitutes one of the connectors;

a lock arm formed on an outer surface of a second housing that constitutes the other connector;

a pair of elastically deformable hinge-shaped feet each having one end integral with the second housing;

each hinge-shaped foot having another end continuing from the lock arm;

the lock arm being formed integral with a pawl corresponding to the lockable lug;

the lock arm capable of rocking about the hinge-shaped feet so as to cause its pawl to engage with the lockable lug;

a push lever having lateral ends formed integral with a rear end of the lock arm and disposed in rear of the hinge-shaped feet;

the second housing further comprising supplementary resilient arms continuing from the rear end of the lock arm; and each supplementary resilient arm being inclined down to extend forwards, with its fore end being fixed on an adjoining portion of the outer surface of the second housing.

2. A connector assembly as defined in claim 1, wherein the fore end of each supplementary resilient arm extends to the proximity of the hinge-shaped feet.

3. A connector assembly as defined in claim 1 or 2, wherein the second housing has along its upper face a guard that is composed of a pair of side plates and a top plate continuing from upper ends of the side plates so that the lock arm intervenes between the side plates and a fore half of the lock arm is covered with the top plate of the guard.

4. A connector assembly as defined in claim 3, wherein the one end of each hinge-shaped foot is fixed on an inner face portion of the side plate of the guard.

5. A connector assembly as defined in claim 1, wherein the second housing of the male connector has a cavity opening forwards so that pin contacts each fixed on a wire end are exposed in the cavity, and the first housing of the female connector fitting in the cavity has compartments holding therein socket contacts insulated from each other and corresponding to the pin contacts.

* * * * *